US005499496A

United States Patent [19]

Stenmans

[11] Patent Number: 5,499,496

[45] Date of Patent: Mar. 19, 1996

[54] METHOD AND DEVICE FOR MANUFACTURING A TWISTED YARN

[75] Inventor: Heinz Stenmans, Grefrath, Germany

[73] Assignee: Palitex Project-Company GmbH, Krefeld, Germany

[21] Appl. No.: 330,061

[22] Filed: Oct. 21, 1994

[30] Foreign Application Priority Data

Oct. 22, 1993 [DE] Germany ..... 43 36 109.9

[51] Int. Cl.[6] ..... D01H 4/08; D01H 4/38; D01H 4/40

[52] U.S. Cl. ..... 57/406; 57/409; 57/413; 57/417

[58] Field of Search ..... 57/404, 406, 408, 57/409, 411, 413, 414, 415, 417

[56] References Cited

U.S. PATENT DOCUMENTS

| | | | |
|---|---|---|---|
| 3,605,395 | 9/1971 | Morikawa et al. | 57/409 |
| 3,757,507 | 9/1973 | Maxham | 57/406 X |
| 4,527,384 | 7/1985 | Stejskal et al. | 57/409 X |
| 4,567,723 | 2/1986 | Safar | 57/404 X |

FOREIGN PATENT DOCUMENTS

| | | | |
|---|---|---|---|
| 468191 | 1/1992 | European Pat. Off. | 57/417 |
| 1801481 | 6/1969 | Germany . | |
| 78710 | 8/1969 | Germany . | |
| 88001 | 11/1971 | Germany . | |
| 1710029 | 2/1972 | Germany . | |
| 1785366 | 3/1972 | Germany . | |
| 3721364 | 1/1989 | Germany . | |
| 3926227 | 2/1990 | Germany . | |
| 4023397 | 1/1992 | Germany . | |

*Primary Examiner*—Joseph J. Hail, III
*Attorney, Agent, or Firm*—Robert W. Becker & Associates

[57] ABSTRACT

In a method of manufacturing a twisted yarn a rotor is rotatably supported on a machine frame. A yarn guide channel extends radially within the rotor over at least a portion of its diameter. A centering eye for the twisted yarn is positioned on the extension of the rotor axis. A yarn guide tube is arranged so as to guide a yarn exiting from the yarn guide channel to the centering eye. A spinning device is rotatably supported on the rotor eccentrically relative to the rotor axis. A fiber strand is dissolved into dissolved fiber material and fed axially through the rotor and upwardly toward the spinning device where at least two spun fibers are produced. The spun fibers are downwardly guided toward the yarn guide channel so as to form a plied yarn. Along this path the spun fibers are subjected to a first twist to form a once twisted yarn by the rotation of the spinning device relative to the rotor. The once twisted yarn is guided into the yarn guide channel, then upwardly into the yarn guide tube and through the centering eye. Along this path the once twisted yarn it is subjected to a second twist to form a twice twisted yarn by the rotation of the rotor counter to the direction or rotation of the spinning device.

11 Claims, 4 Drawing Sheets

METHOD AND DEVICE FOR MANUFACTURING A TWISTED YARN

BACKGROUND OF THE INVENTION

The present invention relates to a method for manufacturing a twisted yarn wherein a rotor is rotably supported on a machine frame and has a yarn guide channel that extends radially relative to the axis of rotation of the rotor over at least a portion of the diameter of the rotor, wherein a yarn exiting from the yarn guide channel is guided through a yarn guide tube to a means for centering located on an extension of the axis of rotation of the rotor whereby into the space above the rotor dissolved fiber material is introduced which is fed through the rotor. The present invention also relates to a device for performing the method as described above.

Such a method and a device for performing the method are, in principle, known from German Patent 37 21 364. In this known method the twisted yarn is manufactured with the aid of a spindle rotor and the yarn exiting from the yarn guide channel is guided under balloon formation to a centering point positioned on an extension of the hollow spindle axle. Into the space defined by the yarn balloon a flowable medium is introduced so as not disturb the yarn balloon. This is achieved by providing the spindle rotor with a plurality of guide vanes arranged in a spoke-like fashion wherein the yarn guide channel extends through one of these guide vanes. In the case of a two-for-one twisting spindle the flowable medium to be introduced into the space defined by the yarn balloon is conditioned air or a two-phase medium such as droplets suspended in air which are to impart a special effect on the yarn. It is also suggested that with this method fiber material can be introduced into the space defined by the yarn balloon.

It is an object of the present invention to provide a method of the aforementioned kind for manufacturing a twisted yarn from at least two yarn components in which method dissolved fiber material is being used and wherein in two subsequent method steps fibers are first generated in a spinning process and directly further processed to form a twisted yarn which is then removed from the device for performing the method.

In German Offenlegungsschrift 1 785 366, originated in 1972, a spinning method is disclosed which at this time was referred to as "element spinning" in which fiber material arranged in a fiber strand forms a rotating balloon in which the fiber strand is subjected to at least two twists per rotation of the balloon and the resulting yarn is removed from the device. The device for performing this known spinning method has a spinning chamber positioned on a spindle. Into the spinning chamber the fiber material is introduced through a fiber feed tube arranged coaxially to the spindle axle and a channel extending radially through the spindle rotor. Within the spinning chamber a collecting ring for the fiber material is provided in which the fiber material is again formed to a roving. The roving or fiber strand exiting from the stretching unit is guided through a channel positioned within the spindle axle. Within the channel the roving is subjected to a first twist. The roving leaves the channel in the radial direction in order to enter a yarn balloon surrounding and rotating about the spinning chamber where the roving is subjected to a second twist.

This principle is also the basis for German Patent Application 40 23 397, originated in 1992, in which again a method for spinning of fibers to yarn as well as a spinning device for performing the method are disclosed wherein the fiber material is guided to a spinning rotor and the yarn is removed by guiding it in the opposite rotational direction so as to form a rotating, coaxial arc about the spinning rotor. The device for performing this known spinning method comprises a spinning rotor supported on a two-for-one rotor which is rotatably supported in a stationary housing. The fiber exiting the spinning rotor is removed via a removal channel, positioned within the two-for-one twister and extending in an arc about the spinning rotor, in order to be guided to the common axis of the spinning rotor and the two-for-one rotor and is then guided upwardly through the drive device of the two-for-one rotor. This imparts a second twist to the fiber. The fiber material is introduced into the spinning rotor through an inlet channel within the two-for-one rotor whereby the inlet opening of the channel is arranged symmetrically to the axis of the two-for-one rotor and the exit opening of the channel is eccentrically positioned to this axis.

The East German Publication 88 001 shows a method for manufacturing a textile yarn which is comprised of at least two spun fibers. In this method two rotor spinning devices positioned atop one another are used whereby the fiber removal tube of the upper rotor spinning device is introduced into the rotor of the lower rotor spinning device and is arranged coaxially to the fiber removal tube of the lower rotor spinning device. The fiber produced within the upper rotor spinning device is combined with the fiber produced in the lower rotor spinning device and wound about it. A yarn balloon is not employed in this method.

SUMMARY OF THE INVENTION

The method of manufacturing a twisted yarn according to the present invention is primarily characterized by the following steps:

- Rotatably supporting a rotor on a machine frame;
- Providing a yarn guide channel within the rotor so as to extend radially relative to an axis of rotation of the rotor over at least a portion of the diameter of the rotor;
- Positioning a means for centering the twisted yarn on an extension of the axis of rotation of the rotor;
- Arranging a yarn guide tube so as to guide a yarn exiting from the yarn guide channel to the means for centering;
- Rotatably supporting a spinning device on the rotor so as to be positioned eccentrically relative to the axis of rotation of the rotor;
- Dissolving a fiber strand into dissolved fiber material;
- Feeding the dissolved fiber material in the axial direction through the rotor into a space above the rotor and upwardly toward the spinning device;
- Producing at least two spun fibers from the dissolved fiber material within the spinning device;
- Guiding the spun fibers downwardly toward the yarn guide channel so as to form a plied yarn;
- Simultaneously to guiding the spun fibers, subjecting the spun fibers to a first twist to form a once twisted yarn by the rotation of the spinning device relative to the rotor;
- Guiding the once twisted yarn into the yarn guide channel and from the yarn guide channel upwardly into the yarn guide tube and toward the means for centering; and
- Simultaneously to guiding the once twisted yarn, subjecting the once twisted yarn to a second twist to form a twice twisted yarn by the rotation of the rotor counter to the direction of rotation of the spinning device.

Preferably, the step of feeding includes the step of guiding the dissolved fiber material coaxially to the axis of rotation of the rotor. Also, the step of subjecting the spun fibers to a first twist preferably includes the step of guiding the spun fibers eccentrically to the axis of rotation. The step of subjecting the once twisted yarn to a second twist preferably includes the step of guiding the one twisted yarn eccentrically to the axis of rotation.

In another embodiment of the present invention, the step of feeding includes the step of guiding the dissolved fiber material eccentrically to the axis of rotation of the rotor and the step of subjecting the spun fibers to a first twist includes the step of guiding the spun fibers eccentrically to the axis of rotation. The step of subjecting the once twisted yarn to a second twist includes the step of guiding the once twisted yarn coaxially to the axis of rotation.

The present invention further relates to a device for manufacturing a twisted yarn according to the inventive method. The device is primarily characterized by:

A rotor rotatably supported on a machine frame and having an axis of rotation and a diameter, the rotor having a bottom portion and a top portion;

A yarn guide channel positioned within the rotor so as to extend radially relative to the axis of rotation of the rotor at least over a portion of the diamter of the rotor;

A means for centering the twisted yarn positioned on an extension of the axis of rotation of the rotor;

A yarn guide tube extending upwardly between the yarn guide channel and the means for centering;

A feeding unit for feeding dissolved fiber material into an area above the rotor, the feeding unit comprising a feed line extending coaxially into the bottom portion of the rotor;

A spinning device connected to the top portion of the rotor so as to be positioned eccentrically to the axis of rotation of the rotor;

The spinning device having a housing that is rotatable relative to the rotor about a rotational axis parallel to the axis of rotation of the rotor;

The spinning device comprising two spinning units positioned within the housing so as to be arranged eccentrically and symmetrically to the rotational axis;

The spinning device further comprising a fiber removal tube connected to the housing so as to be coaxial to the rotational axis of the housing, wherein spun fibers produced by the spinning units are guided together into the fiber removal tube;

The fiber removal tube having an outlet that opens into the yarn guide channel of the rotor;

A feed tube for guiding upwardly the dissolved fiber material from the feed line to the spinning device;

The spinning device further comprising a planet gear connected to the housing so as to be coaxial to the rotational axis;

A stationary sun gear positioned above the rotor so as to be coaxial to the axis of rotation of the rotor wherein the sun gear and the planet gear constitute a planetary gear system, with the rotor being the stay of the planetary gear system; and Wherein a gear ratio of the sun gear to the planet gear is at least 1:1 and wherein a rotation of the rotor causes rotation of the housing in a direction counter to the direction of rotation of the rotor.

Preferably, the planetary gear system is belt-driven and comprises a belt surrounding both the sun gear and the planet gear for coupling the sun gear and the planet gear; and A ratio of the diameter of the sun gear and the diameter of the planet gear is at least 1:1.

Advantageously, the gear ratio of the sun gear to the planet gear is at least 2:1.

Preferably, the feed tube extends coaxially upwardly through and past the rotor and is stationary. The sun gear is preferably fixedly connected to the feed tube. The yarn guide tube is fixedly connected to the rotor and positioned eccentrically to the axis of rotation of the rotor opposite the housing. Preferably, the yarn guide channel extends substantially radially to the yarn guide tube and has a portion circumventing the feed tube.

Expediently, the device further comprises a substantially radially extending bent tube member rotatably connected to the upper end of the feed tube and rotating with a rotor.

Preferably, the device further comprises a guide ring made of wear-resistant material and fixedly connected to the rotor, wherein the guide ring forms part of the portion circumventing the feed tube.

In another embodiment of the present invention a bent tube member is connected to the upper end of the feed tube and extends substantially transverse to the axis of rotation of the rotor. The bent tube member is positioned and in a fixed position on the rotor. The feed line comprises a means for feeding the fiber material in an axial and radial direction through the rotor. The lower end of the feed tube is connected to the means for feeding in order to guide the fiber material upwardly; the feed tube is positioned eccentrically to the axis of rotation of the rotor. The yarn guide tube in this embodiment is arranged coaxially to the axis of rotation and is fixedly connected to the machine frame. The sun gear preferably is fixedly connected to the yarn guide tube. The rotor has a hollow shaft with a free upper end. The yarn guide channel extends radially and opens into the hollow shaft of the rotor. The free upper end of the hollow shaft opens into the lower end of the yarn guide tube.

Preferably, the spinning device is a rotary spinning device comprising two spinning rotors for spinning and a stator fixedly connected to the housing, wherein the two spinning rotors are supported on the stator.

In conventional twisting methods performed with twisting spindles supply spools are arranged above the spindle rotor within the space defined by the yarn balloon which supply spools carry the yarn supply to be twisted. When it is desired to manufacture a twisted yarn directly from dissolved fiber material, a first problem to be solved is that the dissolved fiber material must be introduced into the space defined by the yarn balloon. This object, in general, is solved for other purposes, as, for example, disclosed in the aforementoned German Patent 37 21 364. Based on this prior art knowledge, the basic principle of the invention is that the fiber material introduced through the rotor is first guided into a spinning device positioned on the rotor and the fibers produced by the spinning device are guided through the rotor such that at least two twists are imparted to the fibers in two subsequent steps. Thus, a finished twisted yarn is produced directly from the dissolved fiber material. The supply of the fiber material and the design of the device are such that a disturbance of the yarn balloon, as mentioned in context with the previously discussed prior art, does not occur. In a variant of the method this is achieved by guiding the axially introduced dissolved fiber material past the already formed yarn and the yarn balloon formed is guided within a yarn guide tube, while in another variant of the invention the formation of a yarn balloon is entirely avoided.

The inventive device employs the special and essentially known kinematic conditions of a planetary gear system. As will be explained in the following with the aid of several specific embodiments, it is possible to couple the spinning device which is positioned eccentric to the axis of rotation of the rotor with a planetary gear system to a stationary part of the machine frame such that upon rotation of the rotor the spinning device producing the two fibers rotates counter to the direction of rotation of the rotor. In a particular embodiment the spinning device performs one rotation for each rotation of the rotor. When the produced fibers are then guided from the spinning device in a first direction into the rotor and then counter to this first direction out of the rotor, the rotations of the rotor are imparted to the fibers to form a twisted yarn hoisted according to the two-for-one twisting principle, respectively, multiple-for-one twisting principle.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1 through 5.

Figure 1:
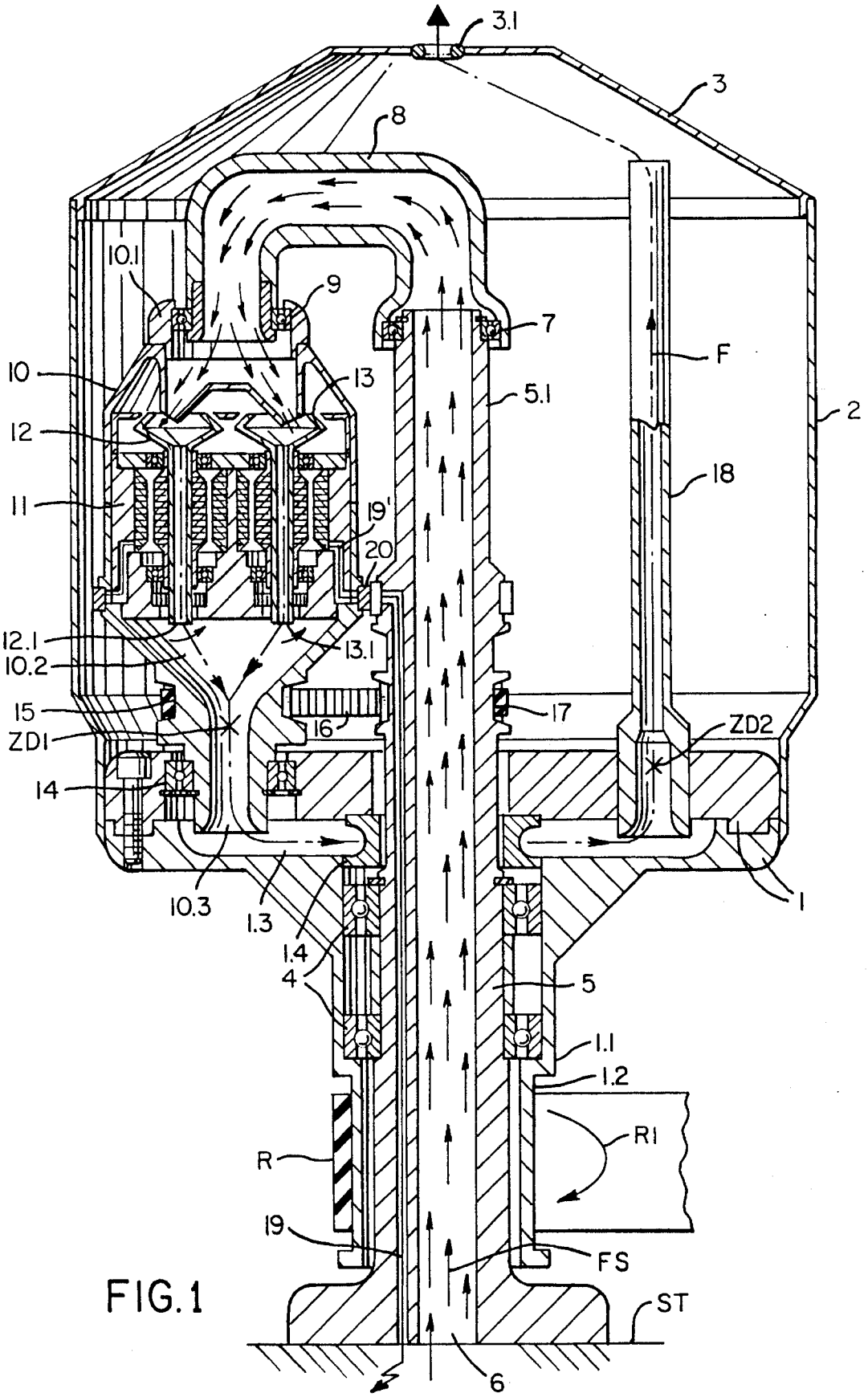
FIG. 1 shows a vertical section of a device for producing a twisted yarn from two yarn components made off dissolved fiber material.
Figure 2:
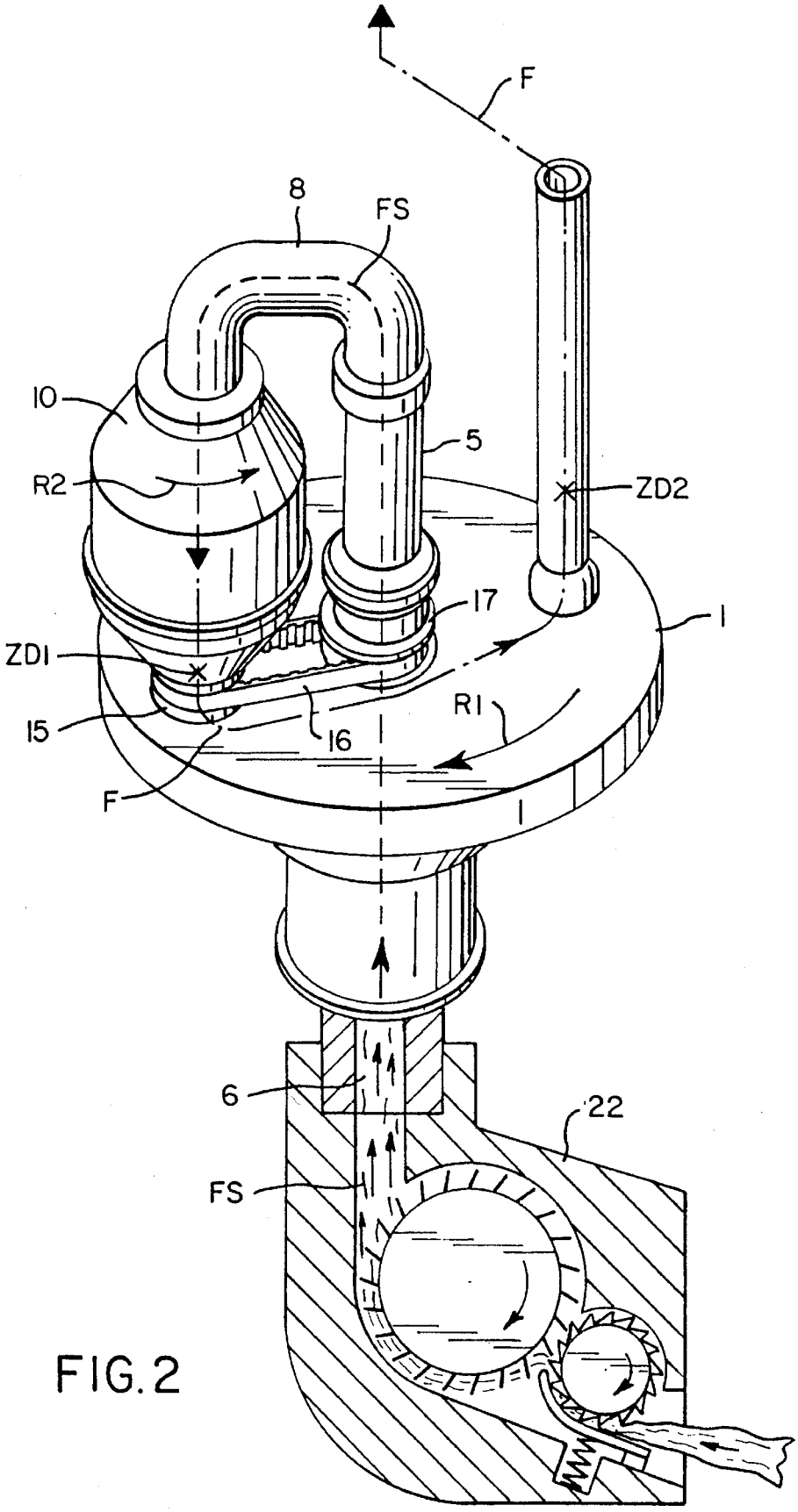
FIG. 2 shows the device according to FIG. 1 on a reduced scale partly in a perspective, partly in a sectional representation with the protective housing removed.
Figure 3:
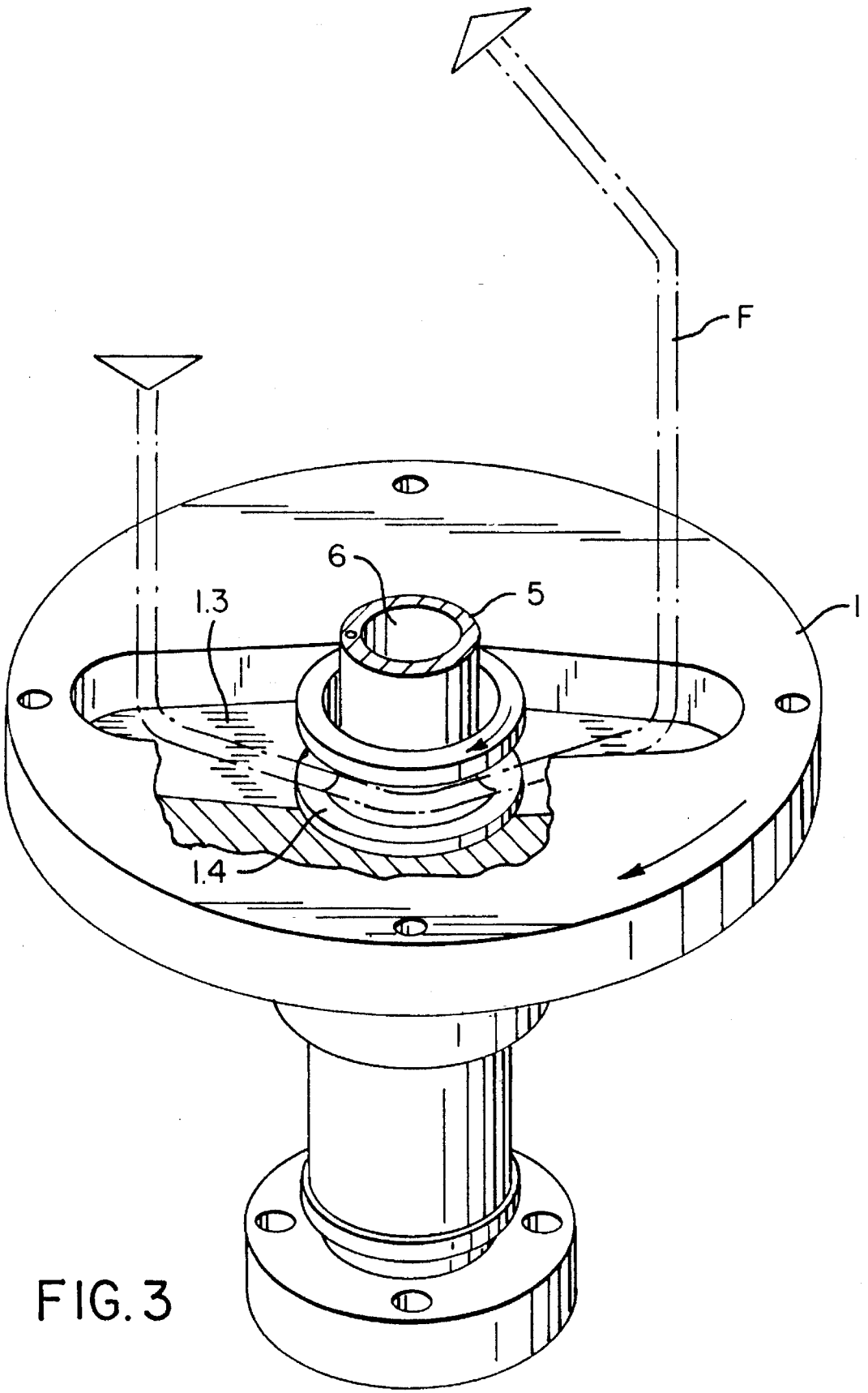
FIG. 3 shows a part of the device of FIGS. 1 and 2 in a perspective representation.

The device represented in FIGS. 1 through 3 has a rotor 1 which is supported rotatably with a central hollow shaft 1.1 via a bearing 4 on a hollow column (feed tube) 5 which is fixedly connected to the machine frame ST. At the lower end of the hollow shaft 1.1 a whorl 1.2 is arranged for engagement by a drive belt R.

The rotor 1 forms the bottom of a closed pot and supports a cylindrical wall 2 which with its lower end is fixedly connected to the rotor 1. A lid 3 is positioned on the cylindrical wall 2. The lid 3 at its highest point is provided with a yarn outlet eye 3.1 (centering eye) positioned on the central axis of the pot. The column (feed tube) 5 extends in the vertical direction through the rotor 1 and forms an extension of the feed line 6 for dissolved fiber material FS extending coaxially to the axis of rotation of the rotor 1.

The housing 10 of the spinning device is arranged on top of the rotor 1 and is positioned eccentrically to the axis of rotation of the rotor 1 which housing at its underside forms a hollow shaft 10.3 as a fiber removal tube which is rotatably supported with a bearing 14 on the rotor 1. The upper part 10.1 of the housing 10 is connected via a rotary bearing 9 to the end of a bent tube member 8 and the other end is connected via a further rotatary bearing 7 to the upper end 5.1 of the column (feed tube) 5. A portion of the hollow shaft 10.3 of the housing 10 is formed as a drive wheel 15 that is coupled via a drive belt 16 to a drive wheel 17 provided at the exterior of the fixed (stationary) column or feed tube 5. The drive wheels 15 and 17 together with the drive belt 16 form a planetary gear system in which the drive wheel 17 is the sun gear that is coupled via the drive belt to the planet gear 15. The stay of the planetary gear system is formed by the rotor 1. As is known in general from the kinematic conditions of planetary gear systems, for a diameter ratio of sun gear 17 to planet gear 15 of 2:1 the housing 10, due to the coupling to the rotational movement of the rotor 1, performs for one rotation of the rotor 1 exactly one rotation in the opposite direction relative to the rotor 1. Of course, it is also possible to use any other gear ratios. When driving the rotor 1 via the drive belt R the housing 10 is thus subjected to the previously mentioned rotational movement without the need for additional drive means.

Within the housing 10 a rotor spinning device is arranged comprising a stator 11 that is fixedly connected to the housing 10. Within the stator 11 two spinning rotors 12 and 13 are arranged eccentrically and symmetrically to the rotational axis of the housing 10 whereby the rotational axis of the spinning rotors 12 and 13 are parallel to one another. Each spinning rotor 12, 13 is provided with a fiber outlet 12.1, 13.1 that is guided downwardly through the stator 11. The two fiber outlets 12.1 and 13.1 open within the housing 10 into a space 10.2 which has a transition into the hollow shaft or fiber removal tube 10.3. The hollow shaft 10.3 opens into a yarn guide channel 1.3 which extends substantially radially within the rotor 1. At the other end of the yarn guide channel 1.3 a yarn guide tube 18 is arranged on the rotor so as to be essentially positioned diametrically opposite to the housing 10. The yarn guide tube 18 extends parallel to the axis of rotation of the rotor 1 in an upward direction. The lower end of the yarn guide tube 18 is connected to the yarn guide channel 1.3. As can be seen in FIG. 3, the yarn guide channel 1.3 is designed such that a yarn F is guided therethrough such that with the aid of a guide ring 1.4 made of wear-resistant material the rotor axis and the central column (feed tube) 5 are circumvented in order for the yarn to reach the yarn guide tube 18.

The drive units for the spinning rotors 12 and 13 which are not represented in the drawings are supplied via line 19 extending through the central column 5, a slip ring 20, and a line 19' extending through the stator 11 with electrical power.

As can be seen in FIG. 2, at the underside of the central column 5 a device 22 (opening roller) for feeding dissolved fiber material FS into the feed line 6 is arranged. Dissolved fiber material refers to individual fibers (staple fibers) that are separated from a loosely gathered fiber strand by an opening roller.

The function of the device represented in FIGS. 1 to 3 will be explained in the following.

The rotor 1 is driven in rotation by the drive belt R in the clockwise direction indicated by arrow R1. Due to the aforementioned coupling of the housing 10 of the spinning device via the planetary gear system 15, 16, 17 with the fixed (stationary) column 5, the housing 10 rotates counterclockwise in the direction of arrow R2 (see FIG. 2). Dissolved fiber material is guided through the feed line 6 and reaches via the bent tube member 8 the upper portion 10.1 of the housing 10 of the spinning device where it is distributed to the two spinning rotors 12 and 13. The two spinning rotors 12 and 13, in general, rotate counter to the direction of rotation of the housing 10. The spun fibers produced within the two spinning rotors 12 and 13 are removed via the fiber outlets 12.1 and 13.1. They form a plied yarn (doubled yarn) and in the lower central hollow shaft 10.3 are subjected to a first twist ZD1. The once twisted yarn is then guided via the yarn guide channel 1.3 and the yarn guide tube 18 and is removed from the device via the yarn outlet eye 3.1. During the upwardly oriented movement through the yarn guide tube 18 toward the yarn outlet eye 3.1 the once twisted yarn is subjected to a second twist ZD2. Guiding the yarn F through the yarn guide tube 18 can be compared to traveling through a yarn balloon of a twisting spindle. However, in the present invention the "yarn balloon" does not freely rotate about the spindle but is guided within the yarn guide tube 18.

Figure 4:
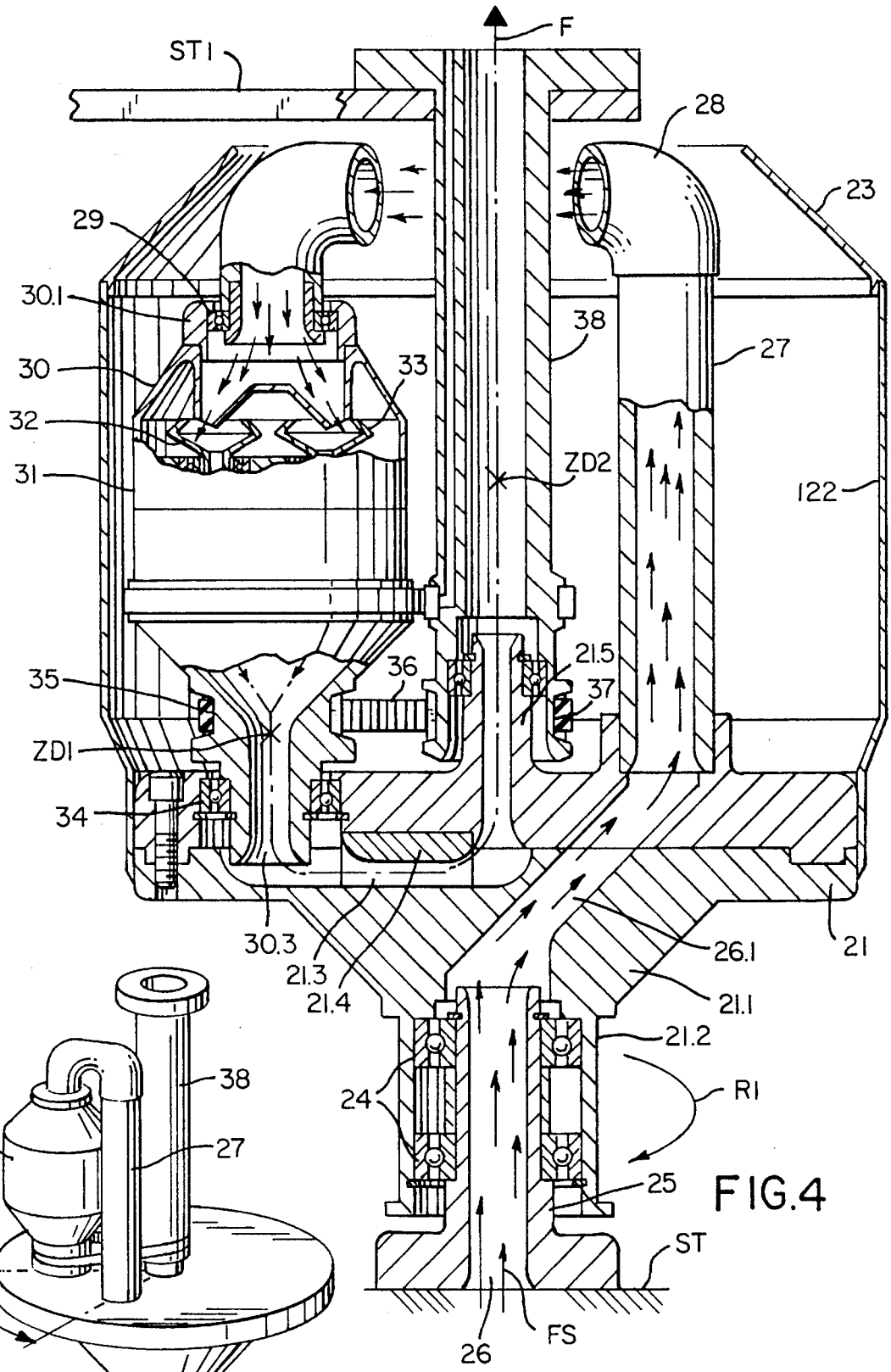
FIG. 4 shows a vertical section of another embodiment of a device for manufacturing a twisted yarn from two yarn components made of dissolved fiber material.
Figure 5:
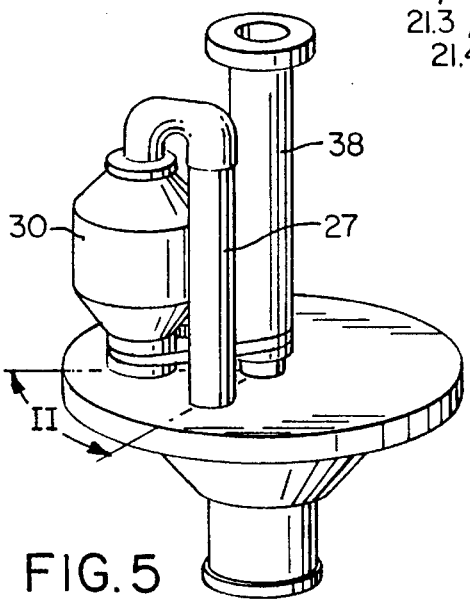
FIG. 5 shows on a reduced scale a perspective representation of the device of FIG. 4 with the protective housing removed.

In the device according to FIGS. 4 and 5 the formation of a yarn balloon is entirely avoided.

The device has a rotor 21 which with its bottom portion 21.1, at which a drive whorl 21.2 is arranged, is supported via a rotary bearing 24 on a column 25 fixedly connected to the machine frame ST. The feed line 26 extends through the column 25 and supplies dissolved fiber material FS to the spinning device. The feed line 26 further comprises a channel 26.1 extending in the radial and axial direction (i.e., at a slant) through the rotor 21 which is then connected to a feed tube 27 that is fixedly connected with the rotor 21 and extends parallel to the axis of rotation of the rotor 21 in the upward direction.

The housing 30 of the spinning device is positioned eccentrically to the axis of rotation on the rotor 21. The housing 30 is rotatably supported with its central lower hollow shaft 30.3 via a bearing 34 on the rotor 21. The hollow shaft 30.3 functions as a fiber removal tube. The rotor 21 has furthermore a hollow axle 21.5 positioned coaxially to the axis of rotation of the rotor and extending upwardly to a predetermined level. The hollow axle 21.5 is introduced from the bottom into a yarn guide tube 38 that is fixedly connected to the machine frame and is connected to the yarn guide tube 38 via a rotary bearing 39. The yarn guide tube 38 extends thus coaxially to the axis of rotation of the rotor 21 and is connected with one end to the machine frame ST1.

The housing 30, in analogy to the device of FIGS. 1 to 3, is coupled with a planetary gear system to the machine frame. For this purpose, the underside of the housing 30 is provided with a planet gear 35 that is coupled via the drive belt 36 to the sun gear 37 which is positioned at the lower end of the fixed connected yarn guide tube 38. The function of this coupling has been explained in connection with the first embodiment of the present invention (FIGS. 1 to 3).

The stator 31 of the rotor spinning device is arranged within the housing 30. The spinning device comprises spinning rotors 32 and 33. Fiber outlets are connected to the spinning rotors 32 and 33 in a manner already disclosed and described in connection with FIG. 1. The upper portion 30.1 of the housing 30 is connected via a rotary bearing 29 to a bent tube member 28 that, as can be seen in FIG. 5, is connected with one end to the upper end of the feed tube 27.

The rotor 21 together with a cylindrical exterior wall 22 and a detachable lid 23 forms a cylindrical pot.

The function of the device according to FIGS. 4 and 5 will be explained in the following.

The rotor 21 is driven in rotation by a non-represented drive belt (in analogy to the embodiment of FIG. 1) and the housing 30 is rotated due to the coupling via the planetary gear system 35, 36, 37 in a direction counter to the rotational direction of the rotor 21. Upon selecting a corresponding gear ratio, one rotation of the rotor 21 corresponds exactly to one rotation of the housing 30. Via the feed line 26 dissolved fiber material FS is guided into the spinning device whereby the fiber material FS is guided through the channel 26.1, the feed tube 27, and the bent tube member 28 into the upper part 30.1 of the housing 30 where it is distributed to the spinning rotors 32 and 33. The spun fibers produced in the spinning rotors 32, 33 are removed in the downward direction. Within the hollow shaft 30.3 of the housing 30 they are subjected to a first twist ZD1. The resulting once twisted yarn is then guided radially through the yarn guide channel 21.3 along the guide element 21.4 to the axis of rotation of the rotor and introduced into the hollow shaft 21.5 from where it is guided into the fixed yarn guide tube 38 and removed in the upward direction from the device. While passing through the yarn guide tube 38, the once twisted yarn is subjected to a second twist ZD2 and forms a twice twisted yarn.

The present invention is, of course, in no way restricted to the specific disclosure of the specification and drawings, but also encompasses any modifications within the scope of the appended claims.

What I claim is:

1. A method of manufacturing a twisted yarn, said method comprising the steps of:

rotatably supporting a rotor on a machine frame;

providing a yarn guide channel within the rotor so as to extend radially relative to an axis of rotation of the rotor over at least a portion of a diameter of the rotor;

positioning a means for centering the twisted yarn on an extension of the axis of rotation of the rotor;

arranging a yarn guide tube so as to guide a yarn exiting from the yarn guide channel to the means for centering;

rotatably supporting a spinning device on the rotor so as to be positioned eccentrically relative to the axis of rotation of the rotor;

dissolving a fiber strand into dissolved fiber material;

feeding the dissolved fiber material in the axial direction through the rotor into a space above the rotor and upwardly toward the spinning device;

producing at least two spun fibers from the dissolved fiber material within the spinning device;

guiding the spun fibers downwardly toward the yarn guide channel so as to form a plied yarn;

simultaneously to guiding the spun fibers, subjecting the spun fibers to a first twist to form a once twisted yarn by the rotation of the spinning device relative to the rotor;

guiding the once twisted yarn into the yarn guide channel and from the yarn guide channel upwardly into the yarn guide tube and toward the means for centering; and simultaneously to guiding the once twisted yarn, subjecting the once twisted yarn to a second twist to form a twice twisted yarn by the rotation of the rotor counter to the direction of rotation of the spinning device.

2. A method according to claim 1, wherein:

the step of feeding includes the step of guiding the dissolved fiber material coaxial to the axis of rotation of the rotor;

the step of subjecting the spun fibers to a first twist includes the step of guiding the spun fibers eccentrically to the axis of rotation; and the step of subjecting the once twisted yarn to a second twist includes the step of guiding the once twisted yarn eccentric to the axis of rotation.

3. A method according to claim 1, wherein:

the step of feeding includes the step of guiding the dissolved fiber material eccentrically to the axis of rotation of the rotor;

the step of subjecting the spun fibers to a first twist includes the step of guiding the spun fibers eccentrically to the axis of rotation; and the step of subjecting the once twisted yarn to a second twist includes the step of guiding the once twisted yarn coaxially to the axis of rotation.

4. A device for manufacturing a twisted yarn, said device comprising:

a rotor rotatably supported on a machine frame and having an axis of rotation and a diameter, said rotor having a bottom portion and a top portion;

a yarn guide channel positioned within said rotor so as to extend radially relative to said axis of rotation of said rotor at least over a portion of said diameter of said rotor;

a means for centering the twisted yarn positioned on an extension of the axis of rotation of the rotor;

a yarn guide tube extending upwardly between said yarn guide channel and said means for centering;

a feeding unit for feeding dissolved fiber material into an area above said rotor, said feeding unit comprising a feed line extending coaxially into said bottom portion of said rotor;

a spinning device, connected to said top portion of said rotor so as to be eccentric to said axis of rotation of said rotor;

said spinning device having a housing that is rotatable relative to said rotor about a rotational axis parallel to said axis of rotation of said rotor;

said spinning device comprising two spinning units positioned within said housing so as to be arranged eccentrically and symmetrically to said rotational axis;

said spinning device further comprising a fiber removal tube connected to said housing so as to be coaxial to said rotational axis of said housing, wherein spun fibers produced by said spinning units are guided together into said fiber removal tube;

said fiber removal tube having an outlet that opens into said yarn guide channel of said rotor;

a feed tube for guiding upwardly the dissolved fiber material from said feed line to said spinning device;

said spinning device further comprising a planet gear connected to said housing so as to be coaxial to said rotational axis;

a stationary sun gear positioned above said rotor so as to be coaxial to said axis of rotation of said rotor, wherein said sun gear and said planet gear constitute a planetary gear system, with said rotor being the stay of said planetary gear system; and wherein a gear ratio of said sun gear to said planet gear is at least 1:1 and wherein a rotation of said rotor causes rotation of said housing in a direction counter to the direction of rotation of said rotor.

5. A device according to claim 4, wherein:

said planetary gear system is belt-driven and comprises a belt surrounding both said sun gear and said planet gear for coupling said sun gear and said planet gear; and a ratio of the diameter of said sun gear and the diameter of said planet gear is at least 1:1.

6. A device according to claim 4, wherein said gear ratio of said sun gear to said planet gear is at least 2:1.

7. A device according to claim 4, wherein said feed tube extends coaxially upwardly through and past said rotor, said feed tube being stationary;

said sun gear is fixedly connected to said feed tube;

said yarn guide tube is fixedly connected to said rotor and positioned eccentric to said axis of rotation of said rotor opposite said housing; and said yarn guide channel extends substantially radially to said yarn guide tube and has a portion circumventing said feed tube.

8. A device according to claim 7, further comprising a substantially radially extending bent tube member rotatably connected to an upper end of said feed tube and rotating with said rotor.

9. A device according to claim 7, further comprising a guide ring made of wear-resistant material and fixedly connected to said rotor, wherein said guide ring forms part of said portion circumventing said feed tube.

10. A device according to claim 4, further comprising a bent tube member connected to an upper end of said feed tube and extending substantially transverse to said axis of rotation of said rotor, said bent tube member being positioned in a fixed position on said rotor; wherein said feed line comprises a means for feeding the fiber material in an axial and radial direction through said rotor;

a lower end of said feed tube is connected to said means for feeding for guiding the fiber material upwardly, said feed tube positioned eccentrically to said axis of rotation of said rotor;

said yarn guide tube is arranged coaxially to said axis of rotation and is fixedly connected to said machine frame;

said sun gear is fixedly connected to said yarn guide tube;

said rotor has a hollow shaft with a free upper end;

said yarn guide channel extends radially and opens into said hollow shaft of said rotor; and said free upper end of said hollow shaft opens into a lower end of said yarn guide tube.

11. A device according to claim 4, wherein said spinning device is a rotary spinning device comprising:

two spinning rotors for spinning; and a stator fixedly connected to said housing, wherein said two spinning rotors are supported on said stator.

* * * * *